US009950829B2

(12) United States Patent
Miller

(10) Patent No.: US 9,950,829 B2
(45) Date of Patent: Apr. 24, 2018

(54) DISPLAYABLE SHIPPING CONTAINER

(71) Applicant: Packaging Corporation of America, Lake Forest, IL (US)

(72) Inventor: Scott M. Miller, Trenton, OH (US)

(73) Assignee: PACKAGING CORPORATION OF AMERICA, Lake Forest, IL (US)

( * ) Notice: Subject to any disclaimer, the term of this patent is extended or adjusted under 35 U.S.C. 154(b) by 837 days.

(21) Appl. No.: 13/749,560

(22) Filed: Jan. 24, 2013

(65) Prior Publication Data

US 2013/0186804 A1 Jul. 25, 2013

Related U.S. Application Data

(60) Provisional application No. 61/590,642, filed on Jan. 25, 2012.

(51) Int. Cl.
*B65D 5/42* (2006.01)
*B65D 5/32* (2006.01)

(52) U.S. Cl.
CPC ..... *B65D 5/4204* (2013.01); *B65D 5/326* (2013.01)

(58) Field of Classification Search
USPC ..... 206/772, 769, 773–774, 45.21; 229/103, 229/240, 120.011
See application file for complete search history.

(56) References Cited

U.S. PATENT DOCUMENTS

| | | | | |
|---|---|---|---|---|
| 3,817,018 | A | 6/1974 | Vickers | 53/32 |
| 5,277,360 | A | 1/1994 | DeMott | 229/122 |
| 5,505,368 | A | 4/1996 | Kanter et al. | 229/23 R |
| 5,507,430 | A | 4/1996 | Imhoff | 229/125.19 |
| 5,842,576 | A | 12/1998 | Snow | 206/736 |
| 5,950,914 | A * | 9/1999 | Dunton et al. | 229/122 |
| 6,109,447 | A * | 8/2000 | Cabana | 206/764 |
| 7,080,736 | B2 * | 7/2006 | Jackson et al. | 206/738 |
| 2005/0263434 | A1 * | 12/2005 | Tibbels | 206/767 |
| 2009/0277953 | A1 | 11/2009 | Mathieu et al. | 229/120.01 |

FOREIGN PATENT DOCUMENTS

| | | | |
|---|---|---|---|
| EP | 1357043 A1 | 10/2003 | B65D 5/06 |
| GB | 2427605 A | 1/2007 | |

* cited by examiner

*Primary Examiner* — J. Gregory Pickett
*Assistant Examiner* — Robert Poon
(74) *Attorney, Agent, or Firm* — Nixon Peabody LLP

(57) ABSTRACT

A container includes a first blank and a second blank. The first blank includes a first plurality of panels and a first plurality of flaps integrally formed from a first sheet of material. The first plurality of panels includes a first side panel, a second side panel opposing the first side panel, a back panel, and a front panel. The first plurality of flaps define a bottom of the container and a first portion of a top of the container. The front panel includes a window portion. The second blank includes two or more panels and two or more top flaps integrally formed from a second sheet of material. The two or more panels include a cover front panel and a first side panel. The two or more top panels define a second portion of the top of the container. The cover front panel is attached to the window panel.

21 Claims, 8 Drawing Sheets

DISPLAYABLE SHIPPING CONTAINER

CROSS-REFERENCE TO RELATED APPLICATIONS

This application claims the benefit of and priority to U.S. Provisional Patent Application No. 61/590,642, titled "Displayable Shipping Container" and filed on Jan. 25, 2012, which is incorporated herein by reference in its respective entirety.

FIELD OF THE INVENTION

The present invention relates generally to containers. In particular, the present invention relates to displayable shipping containers having superior compression features.

BACKGROUND

Flat sheets of corrugated paperboard, typically referred to as blanks, have been used for many years as the starting material to form containers. Corrugated paperboard generally refers to a multi-layer sheet material comprised of two sheets of liner bonded to a central corrugated layer of medium. Given a basic size requirement specified by the customer, industry standards, and the preference for low cost, paperboard container manufacturers strive to provide structural stacking strength with a minimal amount of corrugated paperboard.

In shipping and displaying products, particularly in a retail setting, it is desirable to have a container which is easy to pack, sturdy and fully enclosed for protection of contents during storage and shipping, and also suitable for display at a retail site. For example, it is beneficial to have a container which allows a customer at a retail site to easily reach into the container and remove products for purchase. Of course, the access opening through which a consumer can access the products must also be closed during shipment and storage to prevent spilling of the product out of the container. This has resulted in the development of a variety of containers which are configured to be convertible from a shipping configuration to a display configuration, which permits the converted container to be placed directly upon a shelf, or floor display, without having to remove the individual product items from the container. Typically, this is accomplished by providing the container with removable portions of the container that create apertures through which customers may then help themselves to the products within the converted container.

Such convertible containers represent a challenge in that they must be readily convertible into a form presentable to customers, while at the same time maintaining certain shipping performance characteristics, suitable for the shipment of non-self-supporting or even fragile products. Prior attempts at providing a displayable shipping container may suffer from a number of disadvantages. For example, prior displayable shipping containers often are either lacking in the necessary shipping performance characteristics or, in order to provide such performance, have structural elements that remain in position after converting to a display configuration that make access to the product inconvenient. Other displayable shipping containers are labor intensive to manufacture, assemble, or convert. And still other containers require excessive materials or, in some cases, extraneous components (e.g., a tie or a wrap) to secure a lid on a body of the container. Once converted to a display configuration, many displayable shipping containers often also include rough, unfinished, jagged, and uneven surfaces in prominent locations that are somewhat unsightly and do not provide the appeal of a neat, clean and presentable display.

Therefore, it would be desirable to have a container that addresses many, if not all, of these disadvantages.

SUMMARY

According to some aspects of the present disclosure, a container includes a first blank and a second blank. The first blank includes a first plurality of panels and a first plurality of flaps integrally formed from a first sheet of material. The first plurality of panels includes a first side panel, a second side panel opposing the first side panel, a back panel, and a front panel of the container. The first plurality of flaps define a bottom of the container and a first portion of a top of the container. The front panel includes a window portion. The second blank includes two or more panels and two or more top flaps integrally formed from a second sheet of material. The two or more panels include a cover front panel and a first side panel. The two or more top panels define a second portion of the top of the container. The cover front panel is attached to the window panel.

According to some additional aspects of the present disclosure, a container includes a first blank and a second blank. The first blank includes a first plurality of panels and a first plurality of flaps. The first plurality of panels includes a first side panel, a second side panel opposing the first side panel, a back panel, and a front panel of the container. The first plurality of flaps defines a bottom of the container and a first portion of a top of the container. The front panel includes a removable window portion. The second blank includes a first cover side panel, a cover front panel, and a second cover side panel, and a plurality of top flaps. The plurality of top flaps define a second portion of the top of the container. The cover front panel is attached to the removable window portion of the front panel. The first cover side panel and the second cover side panel are attached to one or more of the first plurality of panels.

According to some additional aspects of the present disclosure, a container includes a first blank and a second blank. The first blank includes a first side panel, a front panel, a second side panel, and a back panel. The first blank further includes a plurality of bottom flaps that define a bottom of the container, a first minor top flap, and a first major top flap. The front panel includes a removable window portion. The second blank includes a cover side panel, a cover front panel, a second minor top flap connected to the first cover side panel, and a second major top flap connected to the cover front panel. An interior surface of the cover front panel is attached to an exterior surface of the removable window portion of the front panel. An interior surface of the cover side panel is attached to an exterior surface of the first side panel.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figures 1A, 1B:
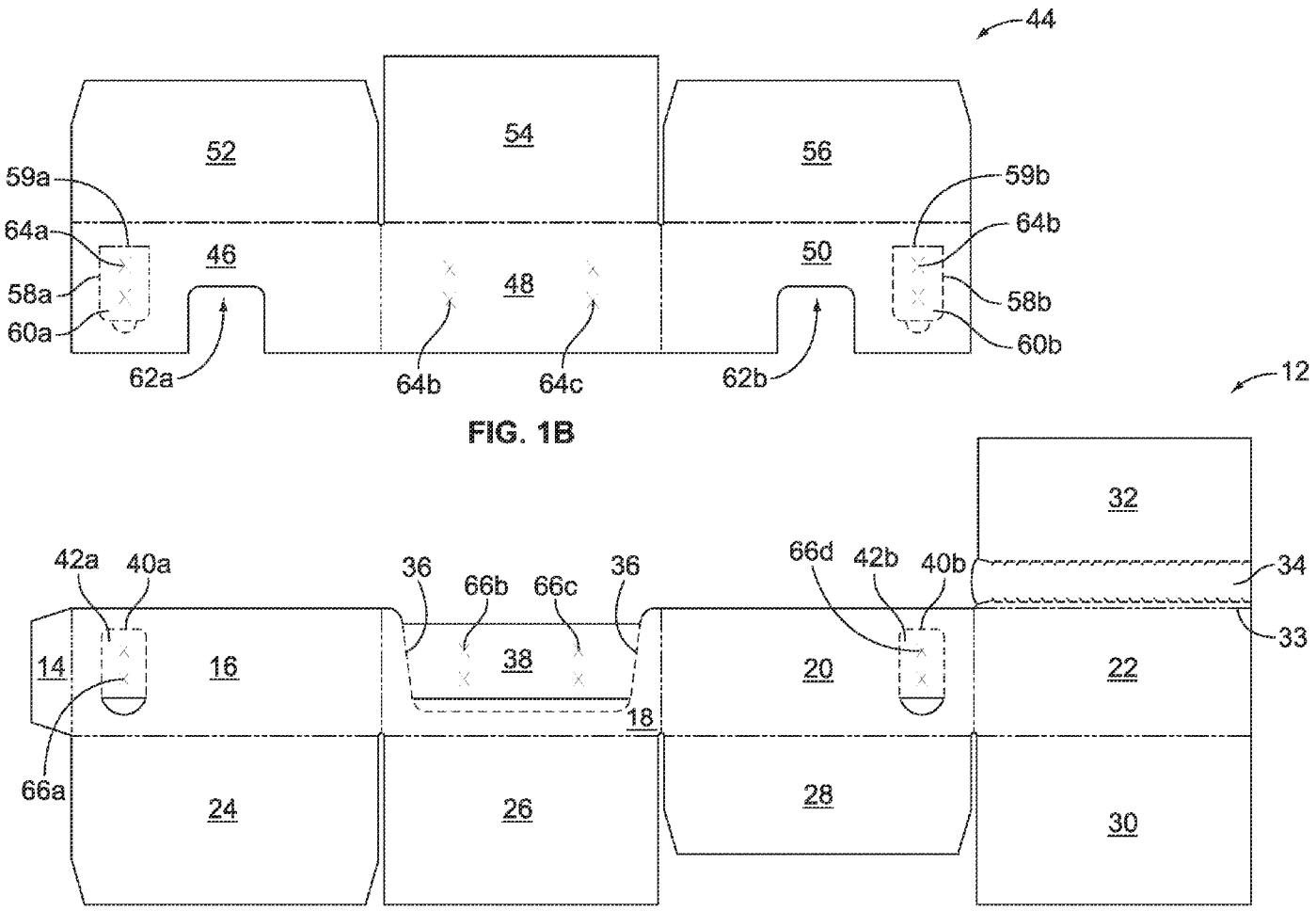
FIG. 1A is a top plan view of a blank for forming an enclosure portion of a container according to one embodiment of the present disclosure.
FIG. 1B is a top plan view of a blank for forming a cover portion of a container according to one embodiment of the present disclosure.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

FIG. 1A illustrates a top plan view of a blank 12 for an enclosure portion of a container according to one embodiment of the present disclosure (also referred to as an "enclosure blank"). The enclosure blank 12 includes an overlap panel 14, a first side panel 16, a front panel 18, a second side panel 20, and a back panel 22. Adjacent panels 14, 16, 18, 20, 22 are connected with one another by substantially parallel fold lines. The overlap panel 14 is configured to be attached to the back panel 22, as described in further detail below.

The enclosure blank 12 further includes a first minor bottom flap 24, a first major bottom flap 26, a second minor bottom flap 28, and a second major bottom flap 30 hingedly connected to the first side panel 16, the front panel 18, the second side panel 20, and the back panel 22, respectively, by fold lines. The enclosure blank 12 also includes a first major top flap 32 hingedly connected to the back panel 22 by a fold line 33. The first major top flap 32 includes a separation element 34 at or near the fold line 33 that connects the first major top flap 32 and the back panel 22. The separation element 34 is configured to permit separation and removal of first major top flap 32 (or a portion thereof) from the back panel 22. In the illustrated embodiment, the separation element 34 comprises a zipper rule; however, it is contemplated that the separation element 34 can comprise any suitable feature for separating and removing the first major top flap 32 (or a portion thereof) from the back panel 22 (e.g., a perforation line, a tear-strip, etc.).

The front panel 18 of the enclosure blank 12 includes a line of weakness 36 that defines a removable window portion 38. The window portion 38 is separable and removable from the remainder of the enclosure blank 12 via the line of weakness 36. It is contemplated that the window portion 38 is not limited to the particular shape, size, and configuration illustrated in FIG. 1. Rather, the window portion 38 can be formed in other shapes, sizes, and/or locations on the front panel 18.

The first side panel 16 includes a line of weakness 40*a* that defines a removable first breakaway portion 42*a* and the second side panel 20 includes a line of weakness 40*b* that defines a removable second breakaway portion 42*b*. As will be described below, the first breakaway portion 42*a* and the second breakaway portion 42*b* are configured to be separable and removable from the remainder of the enclosure blank 12 during conversion from a shipping configuration to a display configuration.

Turning now to FIG. 1B, a top plan view of a blank 44 for an cover portion of the container (also referred to as an "cover blank"). The cover blank 44 includes a first cover side panel 46, a cover front panel 48, and a second cover side panel 50. Adjacent panels 46, 48, and 50 are connected with one another by substantially parallel fold lines. The cover blank 44 further includes a first minor top flap 52, a second major top flap 54, and a second minor top flap 56 hingedly connected to the cover first side panel 46, the cover front panel 48, the cover second side panel 50, respectively, by fold lines.

The first cover side panel 46 includes a first breakaway-assist portion 60*a* defined by a line of weakness 58*a* and a fold line 59*a* and a second breakaway-assist portion 60*b* defined by a line of weakness 58*b* and a fold line 59*b*. The first cover side panel 46 also includes a first recessed surface 62*a* and the second cover side panel 50 includes a second recessed surface 62*b*.

The assembly of the enclosure blank 12 and the cover blank 44 to form the displayable shipping container 10 (see FIG. 2) will now be described. First, the cover blank 44 is attached to the enclosure blank 12. In the embodiment illustrated in FIGS. 1A-1B, the cover blank 44 is attached to the enclosure blank 12 by applying an adhesive generally at or near one or more adhesive areas 64*a-d* of the cover blank 44 and/or one or more adhesive areas 66*a-d* of the enclosure blank 12. As such, it is contemplated that the adhesive(s) can be applied to the adhesive areas 66*a-d* of the enclosure blank 12, the adhesive areas 64*a-d* of the cover blank 44, or both to attach the cover blank 44 to the enclosure blank 12.

With the cover blank 44 attached to the enclosure blank 12, the adhesive area 64*a* is aligned with the adhesive area 66*a*, the adhesive area 64*b* is aligned with the adhesive area 66*b*, the adhesive area 64*c* is aligned with the adhesive area 66*c*, and the adhesive area 64*d* is aligned with the adhesive area 66*d*. Accordingly, the cover front panel 48 is attached to the window portion 38, the first breakaway-assist portion 60*a* is attached to the first breakaway portion 42*a*, and the second breakaway-assist portion 60*b* is attached to the second breakaway portion 42*b*. By attaching the cover blank 44 to the removable breakaway portions 42*a*, 42*b* and the removable window portion 38 of the enclosure blank 12, the cover blank 44 can be secured to the enclosure blank 12 when the container 10 is in a shipping configuration and fully removed (i.e., no portion of the cover blank 44 remains attached to the container 10) when the container 10 is converted to a display configuration. While the breakaway-assist portions 60*a*, 60*b* are illustrated as having a size and shape that is similar to the size and shape of the breakaway portions 42*a*, 42*b*, it is contemplated that the breakaway-assist portions 60*a*, 60*b* can have a size and shape that is different from the shape of the breakaway portions 42*a*, 42*b*.

Figure 2:
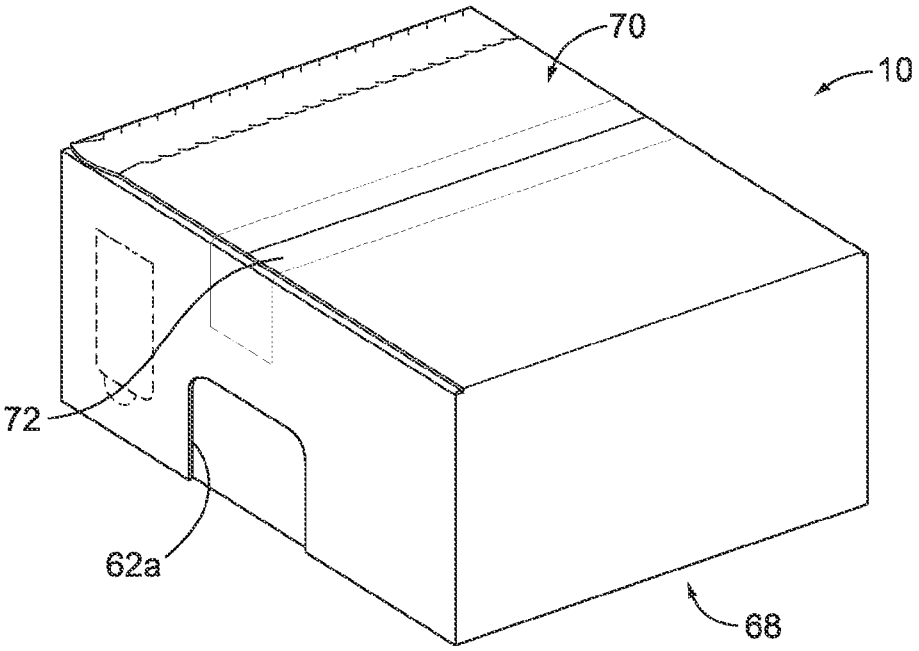
FIG. 2 is a perspective view of the container formed from the blanks of FIGS. 1A-B in a shipping configuration.

After the cover blank 44 has been attached to the enclosure blank 12, the blanks 12, 44 can then be erected to form the assembled container 10 in a shipping configuration as shown in FIG. 2. First, the overlap panel 14 is attached to the back panel 22 by, for example, a suitable adhesive(s). Next, the first minor bottom flap 24 and the second minor bottom flap 28, followed by the first major bottom flap 26 and the second major bottom flap 30, are folded inward (i.e., towards the space formed by the panels 16, 18, 20, 22) and sealed (e.g., by tape, staples, adhesives, combinations thereof, and/or the like) to form a bottom 68 of the container 10. The container 10 can then be optionally filled with products through the top opening of the container 10. Then the first minor top flap 52 and the second minor top flap 56, followed by the second major top flap 54 and the first major top flap 32, are folded inwards and sealed (e.g., by tape, staples, adhesives, combinations thereof, and/or the like) to form a top 70 of the container 10.

The sealing of the first major bottom flap 26 and the second major bottom flap 30 and the sealing of the first major top flap 32 and the second major top flap 54 can be configured to allow (i.e., to not prevent or inhibit) separation and removal of the cover blank 44 from the enclosure blank 12 when the container 10 is later converted to a display configuration. For example, in the embodiment illustrated in FIG. 2, the first major top flap 32 and the second major top flap 54 are sealed with a piece of tape 72 such that the tape 72 does not contact the first side panel 16, the front panel 18, the second side panel 20, or the back panel 22, and the first major bottom flap 26 and the second major bottom flap 30 are sealed by a piece of tape (not shown) such that the tape does not contact any portion of the cover blank 44. Advantageously, the recessed surfaces 62*a*, 62*b* of the cover blank 44 assist in sealing the bottom flaps 26, 30 by providing an area for attaching the tape to the first side panel 16 and the second side panel 20.

It is contemplated that the assembly of the container 10 described above can be achieved with or without the assistance of a case erector. Additionally, it is contemplated that some of these steps can be performed in a different order than is described above. For example, the top 70 of the container 10 can be formed before forming the bottom 68 of the container 10 or the cover blank 44 can be attached to the enclosure blank 12 after the overlap panel 14 is attached to the back panel 22.

As described above, FIG. 2 shows the container 10 in a shipping configuration. In the shipping configuration, the container 10 provides a closed enclosure that prevents loss of product and product damage during shipping. The interior space of this closed enclosure is defined by the top 70, the bottom 68, the first side panel 16, the front panel 18, the second side panel 20, and the back panel 22.

Figure 3A:
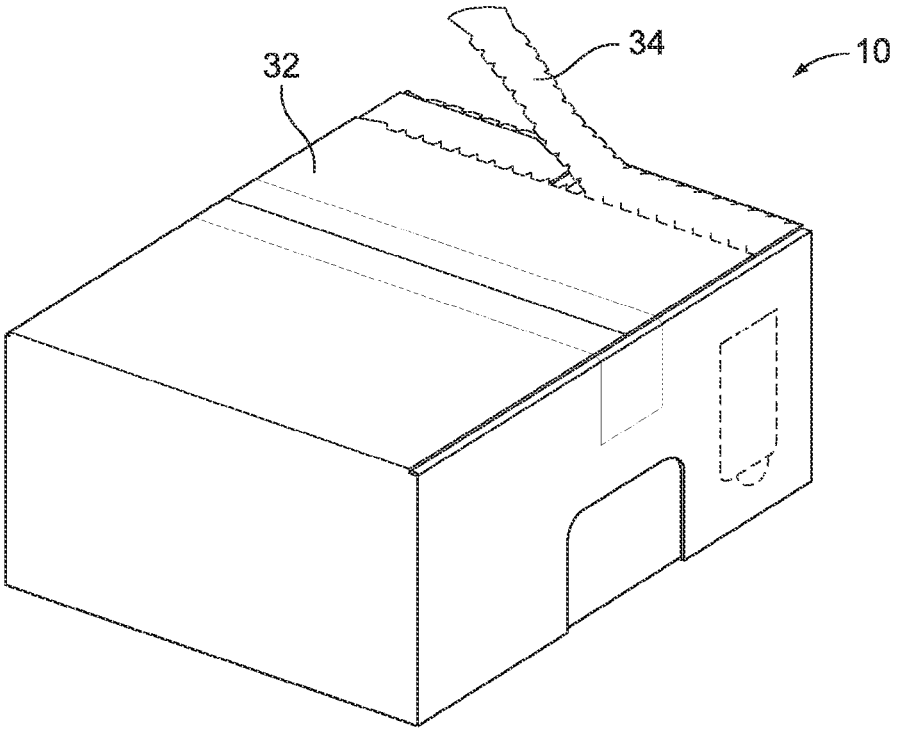
FIGS. 3A-D are perspective views of the container formed from the blanks of FIGS. 1A-B as the container is being converted from a shipping configuration to a display configuration.
Figure 3B:
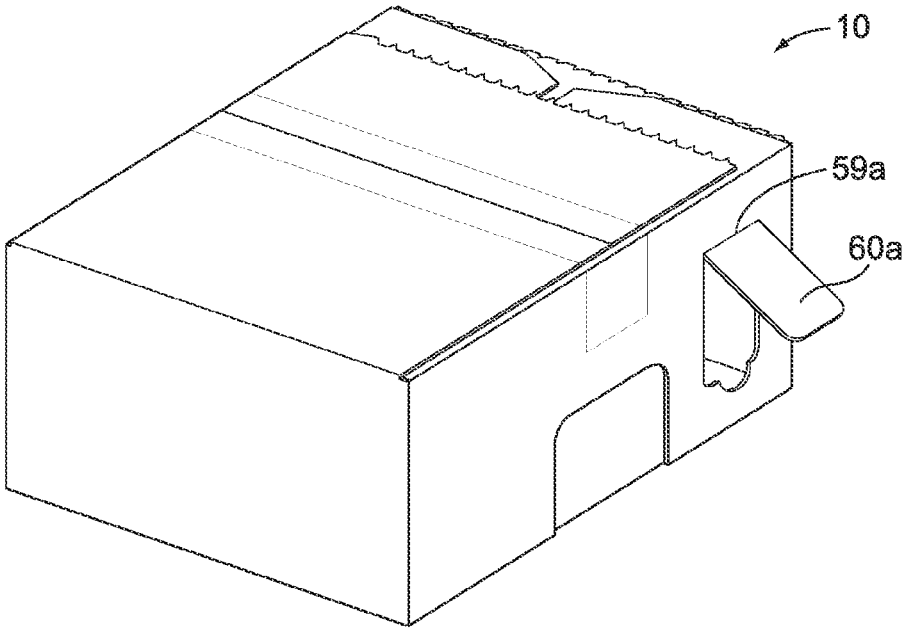
Figure 3C:
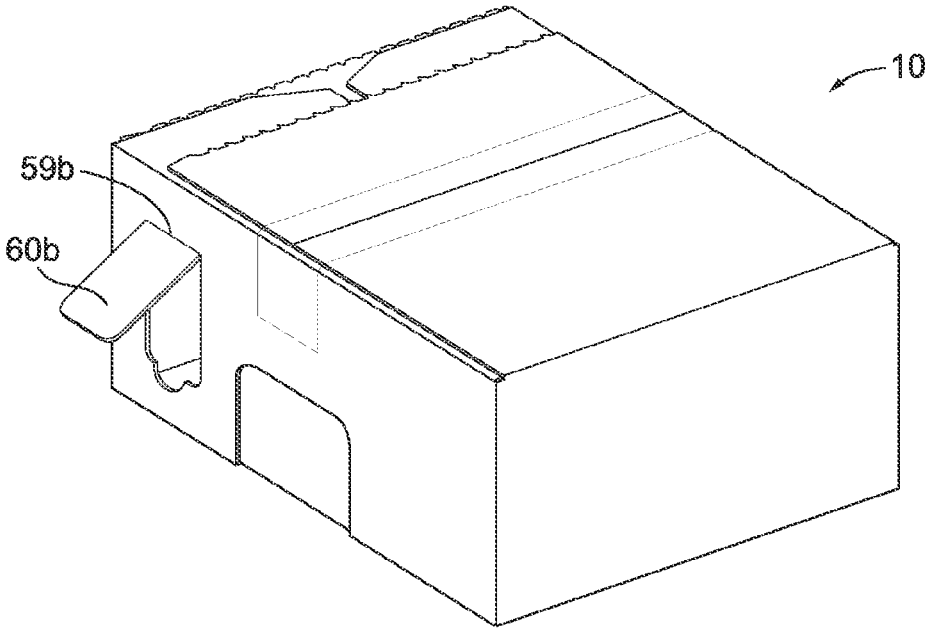
Figure 3D:
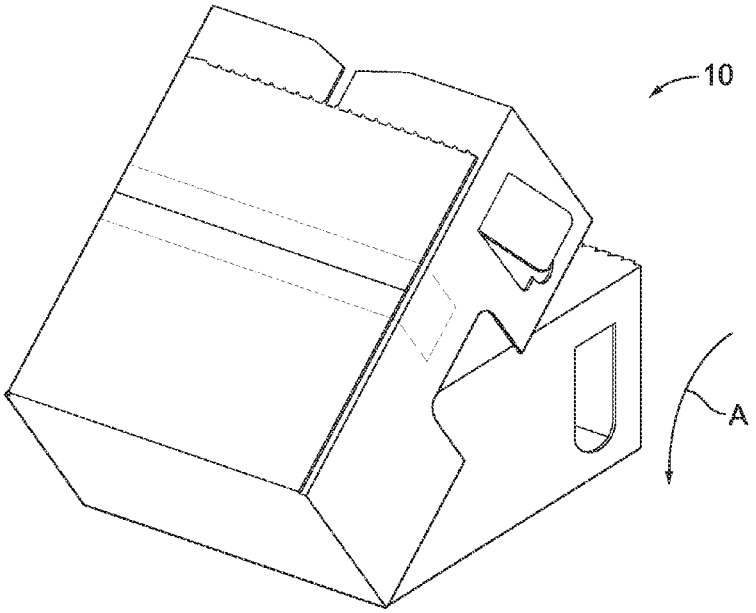

After shipping the container 100 to a retail site, the container 10 can be converted from the shipping configuration (FIG. 2) to a display configuration (FIG. 4) by removing the cover blank 44 and the window portion 38 as shown in FIGS. 3A-D. The following are exemplary steps for converting the container 10 from a shipping configuration to a display configuration as illustrated in FIGS. 3A-B. First, the separation element 34 is actuated to separate the first major top flap 32 (or a portion thereof) from the remainder of the enclosure blank 12 as shown in FIG. 3A. Next, the breakaway-assist portions 60*a*, 60*b* are folded outwardly along the fold lines 59*a*, 59*b* (i.e., in a direction generally away from the interior space of the container 10) as shown in FIGS. 3B-C. Because the breakaway portions 42*a*, 42*b* are attached to the breakaway-assist portions 60*a*, 60*b*, the breakaway portions 42*a*, 42*b* are separated and removed from the first side panel 16 and the second side panel 20 as the breakaway-assist portions 60*a*, 60*b* are outwardly folded. The cover blank 44 and the attached first major top panel 32 can then be pulled in a general direction towards the front panel 18 (e.g., the general direction indicated by arrow A) to separate and remove the window panel 38 from the front panel 18 along the line of weakness 36 as shown in FIG. 3D.

Figure 4:
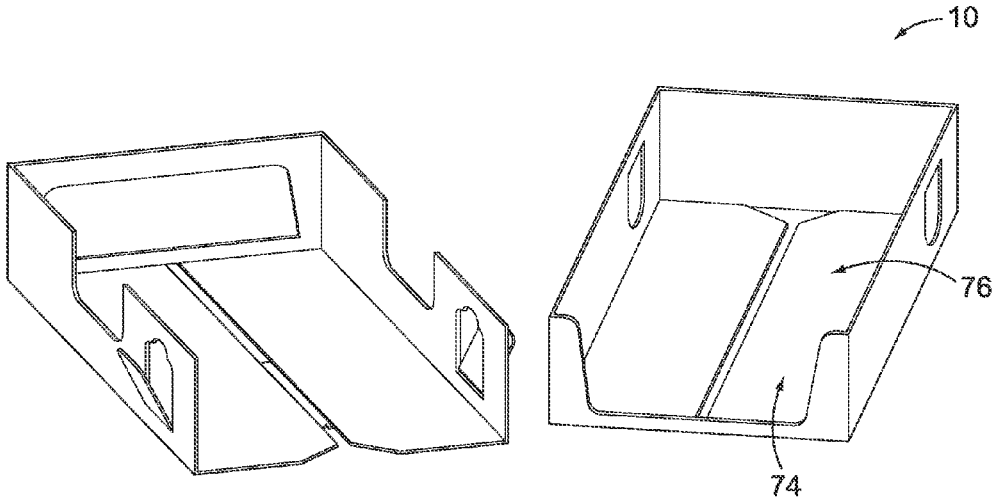
FIG. 4 is a perspective view of the container formed from the blanks of FIGS. 1A-B in a display configuration.

With the window portion 38, the first major top panel 32, and the cover blank 44 removed from the remainder of the enclosure blank 12, the remainder of the enclosure blank 12 forms the container 10 in the display configuration. As shown in FIG. 4, the container 10 in the display configuration includes a window opening 74 formed in the front panel 18 where the window portion 38 was removed. The window opening 74 provides access to the products within the container 10. Additionally, with the container 10 in the display configuration, products within the container 10 can also be accessed from above the container 10 through a top opening 76.

As mentioned above, the container 10 in the display configuration does not include any portion of the cover blank 44 because, in the shipping configuration, the cover blank 44 is only attached to removable portions of the enclosure blank 12 (i.e., the first major top panel 32, the window portion 38, the first breakaway portion 42*a*, and the second breakaway portion 42*b*). As such, the container 10 in the display configuration provides a neat, clean, and presentable display for goods and products within the container 10.

It is contemplated that the container 10 may include advertising features, descriptions, graphics, or other information. Further, it is contemplated that the exterior surface of the cover blank 44 can itself be printed with graphics or text for use during shipment—for example, shipping instructions or information about placement of the item within a store—which are removed along with the cover blank 44 for display of the container 10. In other words, the cover blank 44 can be provided with distribution information thereon, which is unimportant to an end user such as a retail customer and is easily removed for display of the container.

Figures 5A, 5B:
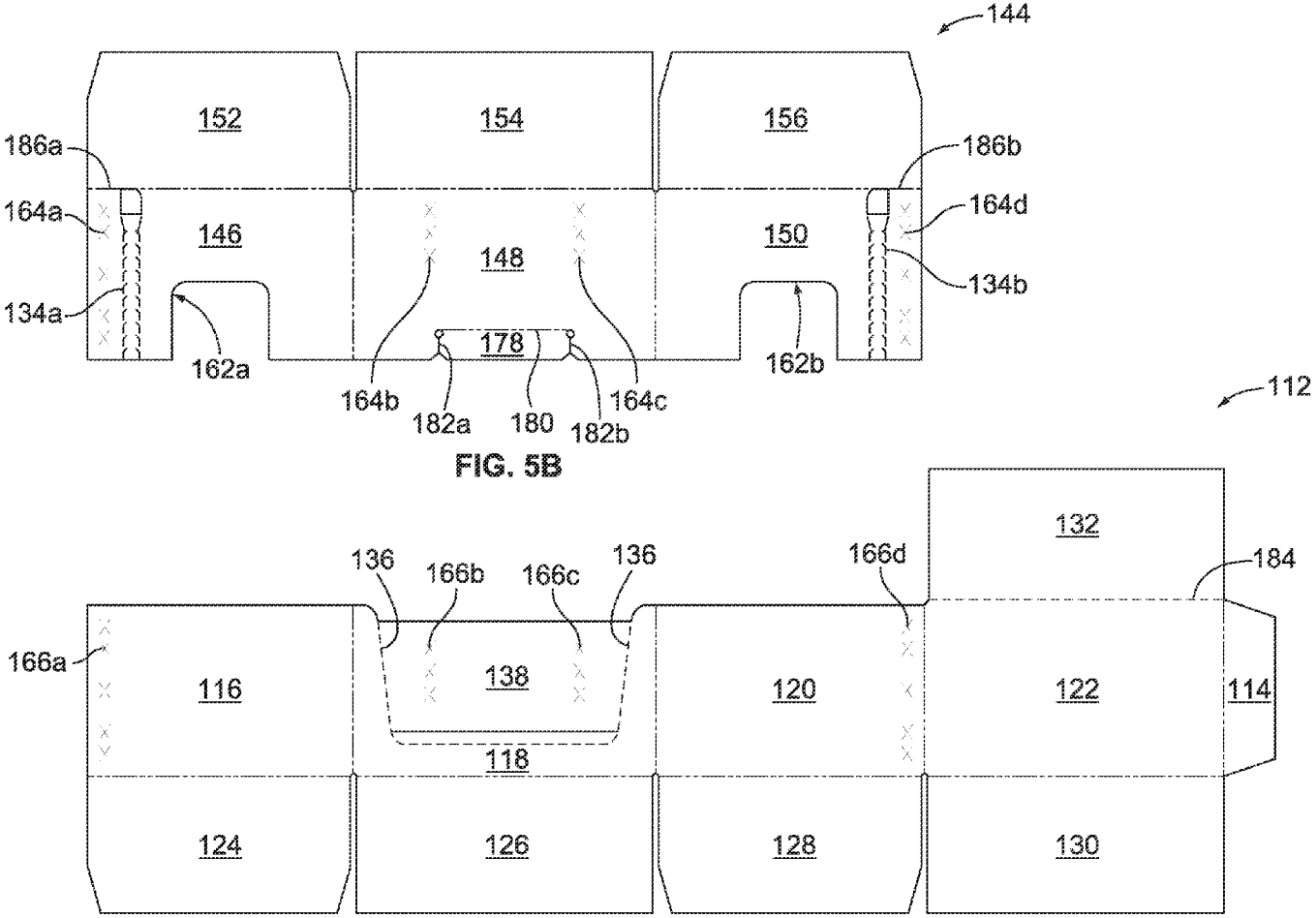
FIGS. 5A-B are top plan views of blanks for forming a container according to another embodiment of the present disclosure.
Figure 5C:
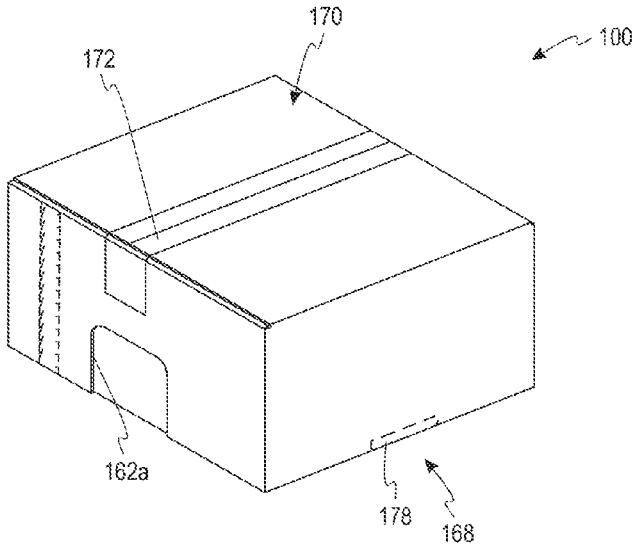
FIG. 5C is a perspective view of the container formed from the blanks of FIGS. 5A-5B.
Figure 5D:
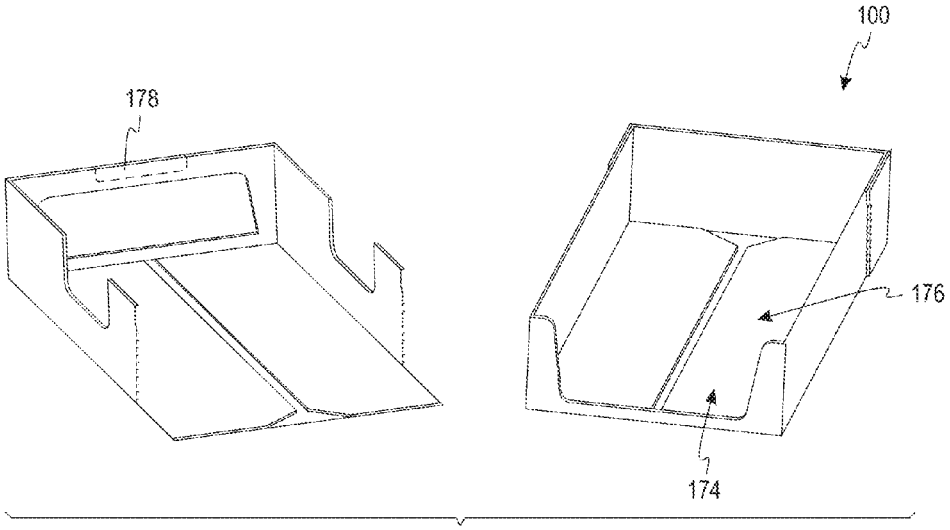
FIG. 5D is a perspective view of the container formed from the blanks of FIGS. 5A-5B in a display configuration.

Turning now to FIGS. 5A-B, top plan views of an enclosure blank 112 and a cover blank 144 according to another exemplary embodiment are illustrated. The enclosure blank 112 includes an overlap panel 114, a first side panel 116, a front panel 118, a second side panel 120, a back panel 122, a first minor bottom flap 124, a first major bottom flap 126, a second minor bottom flap 128, a second major bottom flap 130 connected via fold lines. The enclosure blank 112 further includes a first major top flap 132 connected to back panel 122 by a line of weakness 184. The front panel 118 includes a line of weakness 136 that defines a window portion 138. The enclosure blank 112 also includes adhesive areas 166*a-d*.

The cover blank 144 includes a first cover side panel 146, a cover front panel 148, a second cover side panel 150, a first minor top flap 152, a second major top flap 154, a second minor top flap 156, recessed surfaces 162*a*, 162*b*, and adhesive areas 164*a-d*, which are similar to the similarly numbered features illustrated in FIG. 1B. The cover front panel 148 includes an assist tab portion 178 defined by a fold line 180 and two lines of weakness 182*a*, 182*b*. It is contemplated that according to some alternative embodiments, the lines of weakness 182*a*, 182*b* can instead be die cuts or other means of separation. The first cover side panel 145 includes a first separation element 134*a* disposed between the adhesive area 164*a* and the remainder of the first cover side panel 146, and a second separation element 134*b* disposed between the adhesive area 164*d* and the remainder of the second cover side panel 150. The assist tab portion 178, the first separation element 134*a* and the second separation element 134*b* assist in converting an assembled container 100 from a shipping configuration to a display configuration. The cover blank 144 further includes a line of weakness 186*a* that connects the adhesive area 164*a* of the first cover side panel 146 to the first minor top flap 152 and a line of weakness 186*b* that connects the adhesive area 164*d* of the second cover side panel 150 to the second minor to flap 156.

To assemble the enclosure blank 112 and the cover blank 144 to form a container 100 in a shipping configuration, the cover blank 144 is attached to the enclosure blank 112 via adhesive(s) applied at or near the adhesive areas 164*a-d*, 166*a-d*, the overlap panel 114 is attached to the first side panel 116, the bottom flaps 124, 126, 128, 130 are folded inwards and sealed to form a bottom surface, and the top flaps 152, 154, 156, 132 are folded inwards and sealed to form a top surface as described above. To convert the container 100 from the shipping configuration to a display configuration, the separation elements 134*a*, 134*b* and the lines of weakness 186*a*. 186*b* are actuated or torn out to separate the adhesive area 164*a* from the first cover side panel 146 and the adhesive area 164*d* from the second cover side panel 150. Then the assist tab portion 178 can be pulled in the general direction from the front panel 118 to the back panel 122 to separate and remove the window panel 138 from the front panel 118 along the line of weakness 136. Because the first major top panel 132 is sealed to the cover blank 144 (e.g., via a piece of tape), the first major top panel 132 can then separated and removed from the back panel 122 along the line of weakness 184, for example, by continuing to pull the cover blank 144 in the direction away from the back panel 122. With the window portion 138, the first major top panel 132, and the cover blank 144 removed from the remainder of the enclosure blank 112, the remainder of the enclosure blank 112 forms a container 100 in a display configuration, including a window opening 174 and a top opening 176.

As described above with respect to the container 10 formed from the enclosure blank 12 and the cover blank 44 (FIGS. 1A-B), no portion of the cover blank 44 remained attached to the container 10 in the display configuration (see FIG. 4). By contrast, due to the adhesive areas 164*a*, 164*d* being separated from the remainder of the cover blank 144, the portions of the cover blank 144 including the adhesive areas 164*a*, 164*d* remain attached to the enclosure blank 112 in the display configuration. While the container 10 assembled from the blanks 12, 44 of FIGS. 1A-B can provided a cleaner presentation, the container assembled from the blanks 112, 144 of FIGS. 5A-B provides a more readily apparent prompt for use and the portion of the cover blank 144 that remains attached to enclosure blank 112 is generally not in disposed a prominent location so as to be unsightly.

Figures 6A, 6B:
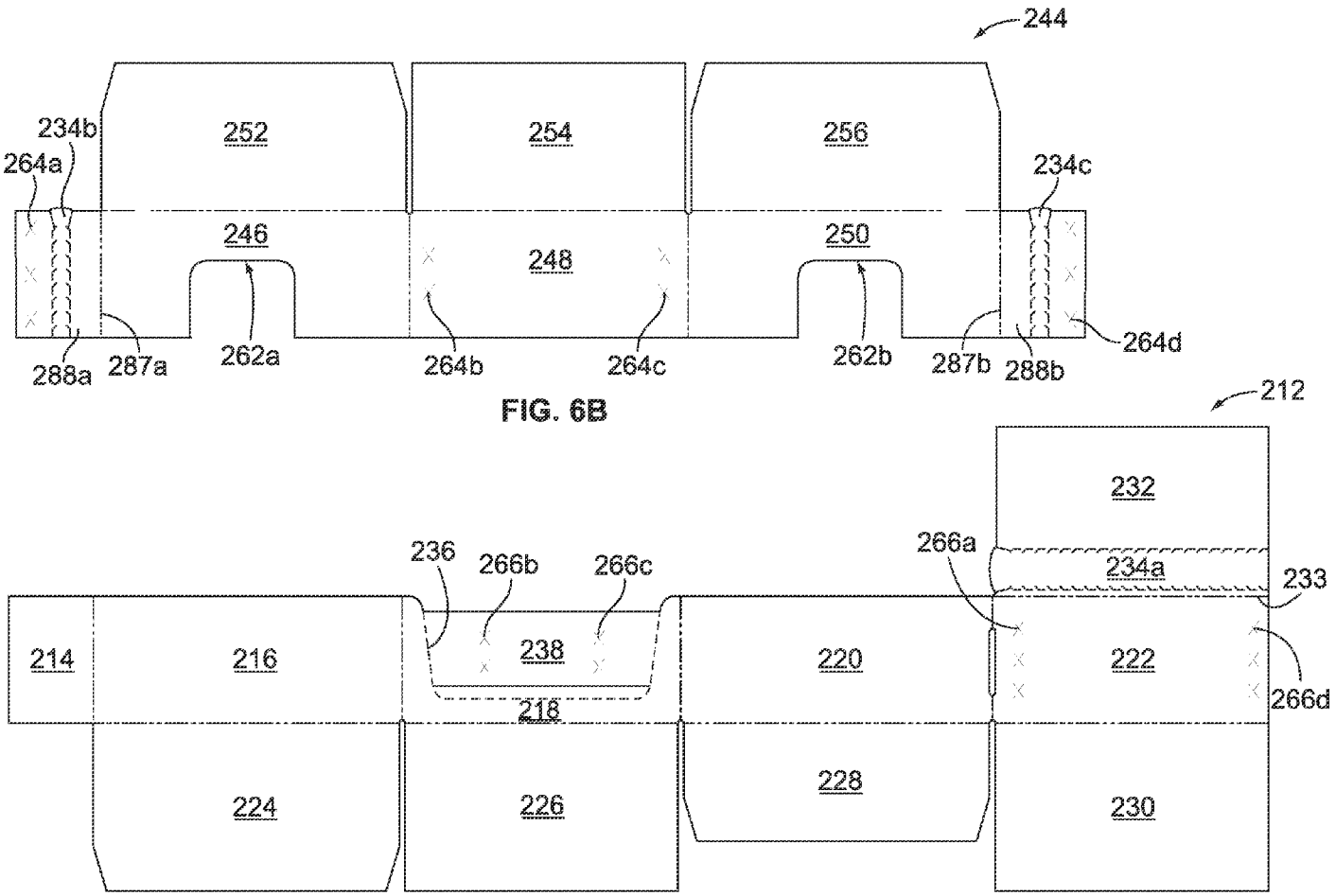
FIGS. 6A-B are top plan views of blanks for forming a container according to another embodiment of the present disclosure.

Turning now to FIGS. 6A-B, top plan views of an enclosure blank 212 and a cover blank 244 according to another exemplary embodiment are illustrated. The enclosure blank 212 includes an overlap panel 214, a first side panel 216, a front panel 218, a second side panel 220, a back panel 222, a first minor bottom flap 224, a first major bottom flap 226, a second minor bottom flap 228, a second major bottom flap 230, and a first major top flap 232 connected via fold lines. The front panel 218 includes a line of weakness 236 that defines a window portion 238. The first major top flap 232 includes a separation element 234*a* at or near the fold line 233 connecting the first major top flap 232 and the back panel 222. The enclosure blank 212 also includes adhesive areas 266*a-d*.

The cover blank 244 includes a first cover side panel 246, a cover front panel 248, a second cover side panel 250, a first minor top flap 252, a second major top flap 254, a second minor top flap 256, and recessed surfaces 262*a*, 262*b*, which are similar to the similarly numbered features illustrated in FIG. 1B. Additionally, the cover blank 244 includes a first cover overlap panel 288*a* connected to the first cover side panel 246 via a fold line 287*a* and a second cover overlap panel 288*b* connected to the second cover side panel 250 via a fold line 287*b*. The first cover overlap panel 288*a* includes an adhesive area 264*a* and the second cover overlap panel 288*b* includes an adhesive area 264*d*. The first cover overlap panel 288*a* further includes a first cover separation element 234*b* disposed between the adhesive area 264*a* and the fold line 287*a* and the second cover overlap panel 288*b* includes a second cover separation element 234*c* disposed between the adhesive area 264*d* and the fold line 287*b* to assist in converting an assembled container from a shipping configuration to a display configuration.

To assemble the enclosure blank 212 and the cover blank 244 to form a container in a shipping configuration, the cover blank 244 is attached to the enclosure blank 212 via adhesive(s) applied at or near the adhesive areas 264*b-c*, 266*b-c*, the overlap panel 214 is attached to the back panel 222, the adhesive areas 264*a*, 264*d* of the cover overlap panels 288*a*, 288*b* are attached to the adhesive areas 266*a*, 266*d* of the back panel 222, the bottom flaps 224, 226, 228, 230 are folded inwards and sealed to form a bottom surface, and the top flaps 252, 254, 256, 232 are folded inwards and sealed to form a top surface as described above. To convert the container from the shipping configuration to a display configuration, the separation elements 234*a-c* are actuated or torn out, and the window portion 238 is separated and removed from the front panel 218 along the line of weakness 236. The resulting container in the display configuration includes a window opening and a top opening. Similar to the container formed from the blanks 112, 144 described above with respect to FIGS. 5A-B, the portions of the cover blank 244 including the adhesive areas 264*a*, 264*d* remain attached to the enclosure blank 212 when the container is in the display configuration.

Figures 7A, 7B:
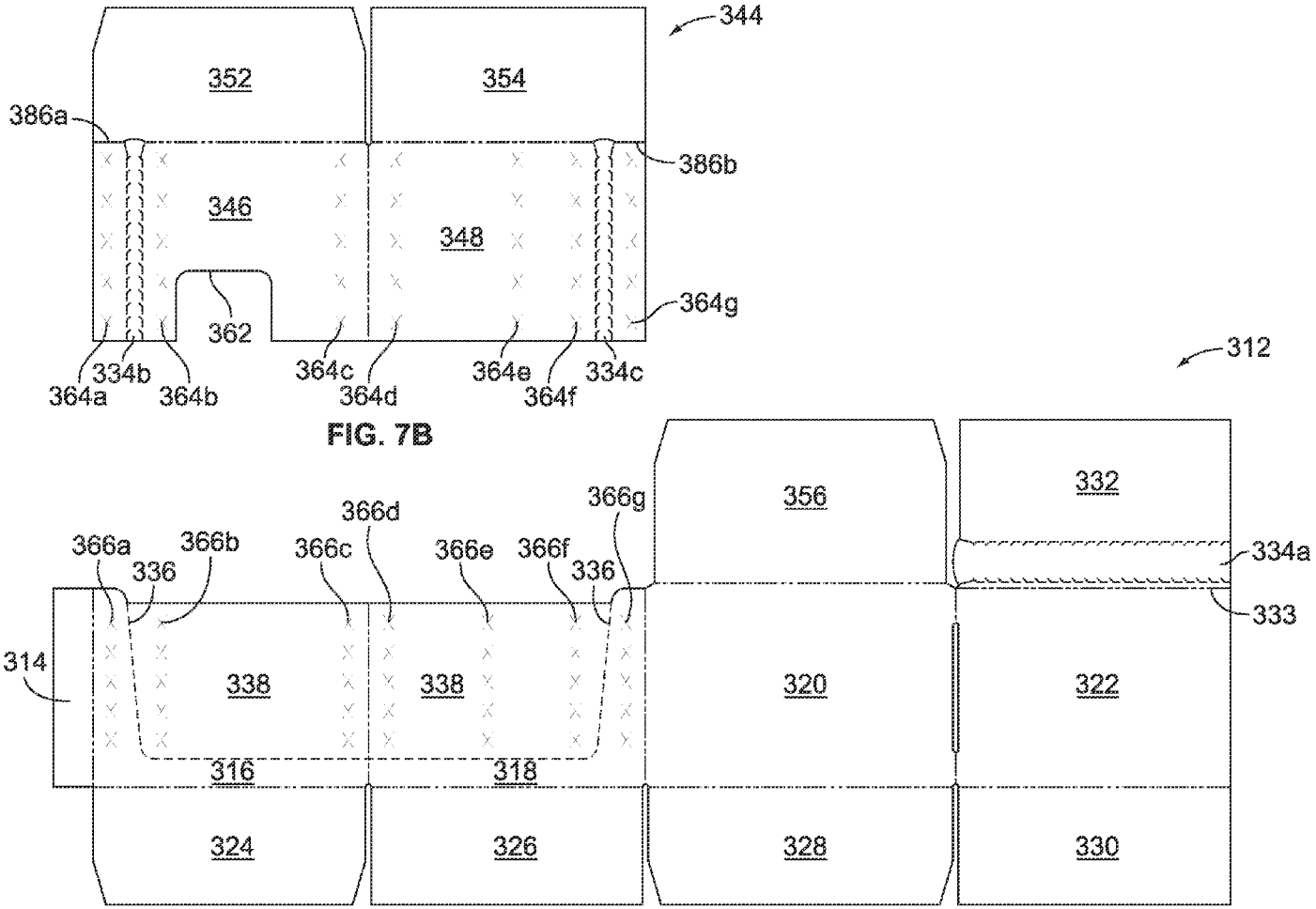
FIGS. 7A-B are top plan views of blanks for forming a container according to another embodiment of the present disclosure.

Turning now to FIGS. 7A-B, top plan views of an enclosure blank 312 and a cover blank 344 according to yet another exemplary embodiment are illustrated. The enclosure blank 312 includes an overlap panel 314, a first side panel 316, a front panel 318, a second side panel 320, a back panel 322, a first minor bottom flap 324, a first major bottom flap 326, a second minor bottom flap 328, a second major bottom flap 330, a first major top flap 232, and a second minor top flap 356 connected via fold lines. The first major top flap 332 includes a separation element 334*a* at or near the fold line 233 connecting the first major top flap 332 and the back panel 322. The enclosure blank 312 includes a line of weakness 336 disposed on the first side panel 316 and the front panel 318 that defines a window portion 338. As such, the window portion 338 spans across the first side panel 316 and the front panel 318. The enclosure blank 212 also includes adhesive areas 366*a-g*.

The cover blank 344 includes a first cover side panel 346, a cover front panel 348, a first minor top flap 352, a second major top flap 354, and recessed surfaces 362, which are similar to the similarly numbered features illustrated in FIG.

1B. The cover blank 344 further includes adhesive areas 364*a-g*. The first cover side panel 346 includes a separation element 364*b* disposed between the adhesive area 364*a* and the adhesive area 364*b*. The cover front panel 348 includes a separation element 364*c* disposed between the adhesive area 364*f* and the adhesive area 364*g*. The adhesive area 364*a* of the first cover side panel 346 is connected to the first minor top flap 352 by a line of weakness 386*a*, and the adhesive area 364*g* of the cover front panel 348 is connected to the second major top flap 354 by a line of weakness 386*b*.

To assemble the enclosure blank 312 and the cover blank 344 to form a container in a shipping configuration, the cover blank 344 is attached to the enclosure blank 312 via adhesive(s) applied at or near the adhesive areas 364*a-g*, 366*a-g*, the overlap panel 314 is attached to the back panel 322, the bottom flaps 324, 326, 328, 330 are folded inwards and sealed to form a bottom surface, and the top flaps 352, 354, 356, 332 are folded inwards and sealed to form a top surface as described above. To convert the container from the shipping configuration to a display configuration, the lines of weakness 386*a-b* and the separation elements 334*a-c* are actuated or torn out, and the window portion 338 is separated and removed from the first side panel 316 and the front panel 318 along the line of weakness 336. The resulting container in the display configuration includes a window opening and a top opening. In particular, the window opening spans two sides of the container in the display configuration to allow for even greater access to goods or products within the container. Similar to the container formed from the blanks 112, 144 described above with respect to FIGS. 5A-B, the portions of the cover blank 344 including the adhesive areas 364*a*, 364*g* remain attached to the enclosure blank 312 when the container is in the display configuration.

It is contemplated that the features described above for the various embodiments illustrated in the figures can be combined. For example, the breakaway portions and the breakaway-assist portions, the assist tab portion, the cover overlap flaps, the window portion spanning multiple panels, or any of the separation elements can be provided in any combination in accordance with the concepts of the present disclosure. Additionally, although the overlap panel has been illustrated and described as being attached to either a first side panel or a back panel, it will be appreciated that an overlap panel can be connected to a second side panel or a front panel in some embodiments.

The above containers provide a number of advantages over other displayable shipping containers. It has been discovered that prior containers that had a cover that encompassed all sides of the inner enclosure tend to have an imbalance of compression strength from front to back (due, in part, to the window in the front of the container). As a result such prior containers required additional material or different strengths of material to compensate for the lack or non-uniformity of compressions strength at the front of the container. The containers of the present disclosure provide improved and more uniform compression strength characteristics due to the cover panels being located over the window portion(s) and one or two side panels, while at the same time reducing the amount of material required and lowering the costs of manufacture.

Additionally, for example, when the cover includes a front panel and two side panels, important graphics on the exterior can be protected during transit. Generally, the graphics on the back panel are not as important to protect because the customer is not likely to see the back panel when the container is being used in a display configuration. Moreover, for example, providing a cover blank that includes two or three panels reduces binding during manufacture and assembly of the containers. Additionally, for example, the containers of the present disclosure can include window openings that span multiple sides of the container, thus providing greater access to goods and products within the containers. And still further, for example, the containers of the present disclosure can be configured such that no portion of the cover blank remains attached to the container in the display configuration or the containers can be configured such that the portions of the cover blank that remain attached to the container in the display configuration are relatively small in size and located in non-prominent locations on the container (e.g., on or near the back panel of the container).

The containers of the embodiments described herein are typically manufactured using corrugated paperboard, preferably with the corrugations running in a vertical direction for increased strength. As non-limiting examples, the container is manufactured from C-flute, EB-flute, E-flute or B-flute corrugated paperboard. It is to be understood that the principles of this invention could be applied to containers made of other materials, such as non-corrugated paperboards, cardboard, corrugated fiberboard, non-corrugated fiberboard, solid-fiber board, polymeric materials, and other foldable materials.

While the containers of the embodiments described above include glue or adhesive for attaching various panels and flaps of the containers, it is contemplated that any other suitable method of joining or attaching panels and flaps may be utilized such as, for example, staples, tapes, a system of corresponding slits and tabs, combinations thereof, and/or the like.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A container comprising:

a first container part formed from a first blank, the first blank including a first plurality of panels and a first plurality of flaps, the first plurality of panels including a first side panel, a second side panel opposing the first side panel, a back panel, and a front panel of the container, the first plurality of flaps defining a bottom of the container and a first exterior portion of a top of the container, the front panel including a removable window portion; and a second container part formed from a second blank, the second blank including two or more panels and two or more top flaps, the two or more panels including a cover front panel and a first cover side panel, the two or more top flaps defining a second exterior portion of the top of the container, the cover front panel being attached to the removable window portion of the front panel and the first cover side panel being attached to one of the first plurality of panels.

2. The container of claim 1, wherein an interior surface of the cover front panel is attached to an exterior surface of the removable window portion.

3. The container of claim 1, wherein the first cover side panel includes a recessed surface configured to permit the bottom to be sealed by a first sealing element that is attached to at least one of the plurality of panels.

4. The container of claim 1, wherein the first blank further includes a breakaway portion and the second blank further includes a breakaway-assist portion, the breakaway portion being attached to the breakaway-assist portion such that the breakaway portion can be removed from the first blank by movement of the breakout-assist portion.

5. The container of claim 1, wherein the second blank includes an assist tab portion configured to assist in a conversion of the container from a shipping configuration to a display configuration.

6. The container of claim 1, wherein the first plurality of flaps includes a major top flap, the major top flap including a separation element configured to separate at least a portion of the major top flap from the first blank.

7. The container of claim 1, wherein the second blank includes a separation element configured to assist in separating at least a portion of one of the second plurality of panels from the second blank.

8. The container of claim 1, wherein the first side panel includes the removable window portion and the first cover side panel is attached to the removable window portion.

9. A container comprising:

a first container part formed from a first blank, the first blank including a first plurality of panels and a first plurality of flaps, the first plurality of panels including a first side panel, a second side panel opposing the first side panel, a back panel, and a front panel of the container, the first plurality of flaps defining a bottom of the container and a first portion of a top of the container, the front panel including a removable window portion; and a second container part formed from a second blank, the second blank including a first cover side panel, a cover front panel, and a second cover side panel, and a plurality of top flaps, the plurality of top flaps defining a second portion of the top of the container, the cover front panel being attached to the removable window portion of the front panel, the first cover side panel and the second cover side panel being attached to one or more of the first plurality of panels.

10. The container of claim 9, wherein the first cover side panel is attached to the first side panel and the second cover side panel is attached to the second side panel so as to attach the second blank to the first blank on at least three sides of the container.

11. The container of claim 10, wherein the first side panel includes a first breakaway portion, the second side panel includes a second breakaway portion, the first cover side panel includes a first breakaway-assist portion, and the second cover side panel includes a second breakaway-assist portion, the first breakaway portion being attached to the first breakaway-assist portion, the second breakaway portion being attached to the second breakaway-assist portion.

12. The container of claim 9, wherein the first plurality of flaps includes a second major top flap, the second major top flap including a separation element configured to separate at least a portion of the second major top flap from the first blank.

13. The container of claim 10, wherein the first cover side panel includes a first separation element and the second cover side panel includes a second separation element, the first separation element being configured to separate a first portion of the first cover side panel from the second blank, the second separation element being configured to separate a second portion of the second cover side panel from the second blank, the first portion of the first cover side panel being attached to the first side panel of the first blank, the second portion of the second cover side panel being attached to the second side panel of the first blank.

14. The container of claim 10, wherein the second blank further includes a first cover overlap panel connected to the first cover side panel and a second overlap cover panel connected to the second cover overlap panel.

15. The container of claim 14, wherein first cover overlap panel includes a first separation element and the second cover overlap panel includes a second separation element and wherein the first separation element is configured to separate a first portion of the first cover overlap panel from the second blank, the second separation element being configured to separate a second portion of the second overlap side panel from the second blank, the first portion of the first cover overlap panel and the second portion of the second cover overlap panel being attached to the back panel of the first blank.

16. The container of claim 10, wherein the second blank is attached to the first blank in a shipping configuration such that the second blank can be entirely removed from the first blank in a display configuration by at least one of a separation element, a line of weaknesses, and a removable portion of a panel of the first blank.

17. The container of claim 10, wherein the first side panel includes the removable window portion and the first cover side panel is attached to the removable window portion.

18. The container of claim 9, wherein the cover front panel is attached to the first blank only at an exterior surface of the removable window portion.

19. The container of claim 10, further comprising:

an assist-tab portion hindgedly coupled to the cover front panel and configured to assist in a conversion of the container from a shipping configuration to a display configuration; and a first recess on the first cover side panel and a second recess on the second cover side panel configured to permit the bottom to be sealed by at least one sealing element that is attached to the first side panel and the second side panel while the first cover side panel is attached to the first side panel and the second cover side panel is attached to the second side panel.

20. The container of claim 9, wherein the first cover side panel and the second cover side panel extend from the back panel to the front panel such that the first cover side panel and the second cover side panel substantially cover the entire first side panel and the entire second side panel, respectively.

21. The container of claim 1, wherein the first exterior portion is coupled to the back panel by a line of weakness such that the container can be converted from a shipping configuration to a display configuration in which the removable window portion, the first exterior portion of the top, and the second exterior portion of the top are removed from a remainder of the container.

* * * * *